US006089908A

United States Patent [19]

Huang

[11] Patent Number: 6,089,908

[45] Date of Patent: Jul. 18, 2000

[54] NETWORK CABLE TESTER ASSEMBLY

[76] Inventor: Hobbes Huang, No. 21, Alley 9, Lane 27, Sec. 5, Min Sheng E. Rd., Taipei, Taiwan

[21] Appl. No.: 09/295,749

[22] Filed: Apr. 20, 1999

[51] Int. Cl.[7] ..... H01R 13/60; H01R 13/52

[52] U.S. Cl. ..... 439/528; 439/283

[58] Field of Search ..... 439/528, 283, 439/353, 324

[56] References Cited

U.S. PATENT DOCUMENTS 5,158,473 10/1992 Takahashi et al. ..... 439/353

5,708,706 1/1998 Hughes et al. ..... 379/446

*Primary Examiner*—Lincoln Donovan

*Assistant Examiner*—Chandrika Prasad

*Attorney, Agent, or Firm*—Rosenberg, Klien & Lee

[57] ABSTRACT

An improved structure of a network wire tester is disclosed. The improved structure of a network wire tester includes a primary device and a secondary device installed with respective network receptacles. The bottom of the primary device is left with a concave container, Two sides of the container are installed with respect long holes and buckle grooves. The two sides of the secondary device are formed with suspending elastic pressing buckles. Each of the elastic pressing buckle is installed with a hook and a protruded pressing key so that the primary device and the secondary device can be assembled to the two ends of a network wire to be tested so to detect the transmission quality. When they are not used, the secondary device is pushed into the container of the primary device to be hidden therein by the elastic pressing buckles to buckle the buckle grooves. Thus, the primary device and the secondary device are combined together and the space is used efficiently. Thus it can be carried and stored conveniently and has a complete and beautiful outlook. It is only needs to press the pressing keys on the two sides, the secondary device and the primary device may be easily pulled out by the user.

4 Claims, 7 Drawing Sheets

NETWORK CABLE TESTER ASSEMBLY

FIELD OF THE INVENTION

The present invention relates to an improved structure of a network cable tester, and specifically to an improved structure of a network cable tester having a primary device and a secondary device which may be coupled via network plugs to two ends of network cables so as to test the quality of transmission therethrough.

BACKGROUND OF THE INVENTION

A conventional network cable tester 1 is shown in FIG. 1. The tester includes a primary device 10 and a secondary device 11 which, in turn, include respective RJ-45 type network receptacles 100, 110. During use, a network plug 20 at one end of a network cable 2 to be tested is inserted into the network receptacle 100 of the primary device 10, while a network plug 21 at another end of the network cable 2 is inserted into the network receptacle 110 of the secondary device 11 in order to test the cable's transmission quality and general ability to conduct signals. The primary device 10 and the secondary device 11 must be used together, yet they are separately provided without any connection. Thus, the cable tester 1 is very inconvenient to carry and store, and does not provide efficient use of space.

In some network cable testers, the primary device is installed with a dovetail groove or strip, such that the secondary device may be coupled thereto (via the dovetail groove or strip). However, such network testers still occupy space inefficiently. Also, the two devices by force, diminishing the tester's ease of use. During use, moreover, the dovetail groove or strip will protrude from the side thereof, making it awkward for the user to hold/manipulate the primary or secondary devices.

SUMMARY OF THE INVENTION

The primary object of the present invention is to provide an improved structure for a network cable tester. The improved structure for a network cable tester includes a primary device and a secondary device equipped with respective network receptacles. The primary device and the secondary device may be assembled to two ends of a network cable to be tested so as to detect its transmission quality. When not in use, the secondary device is stowed within the housing of the primary device and retained therein by the engagement of resilient pressing buckles to corresponding buckle grooves. Thus, the primary device and the secondary device may be combined together in order to make efficient use of space. Thus, not only does the network cable tester provide for convenient carrying and storage, it provides for a neat and aesthetically pleasing assembly.

The various objects and advantages of the present invention will be more readily understood from the following Detailed Description when read in conjunction with the appended Drawings.

DETAILED DESCRIPTION OF THE PREFERRED EMBODIMENTS

Figure 1:
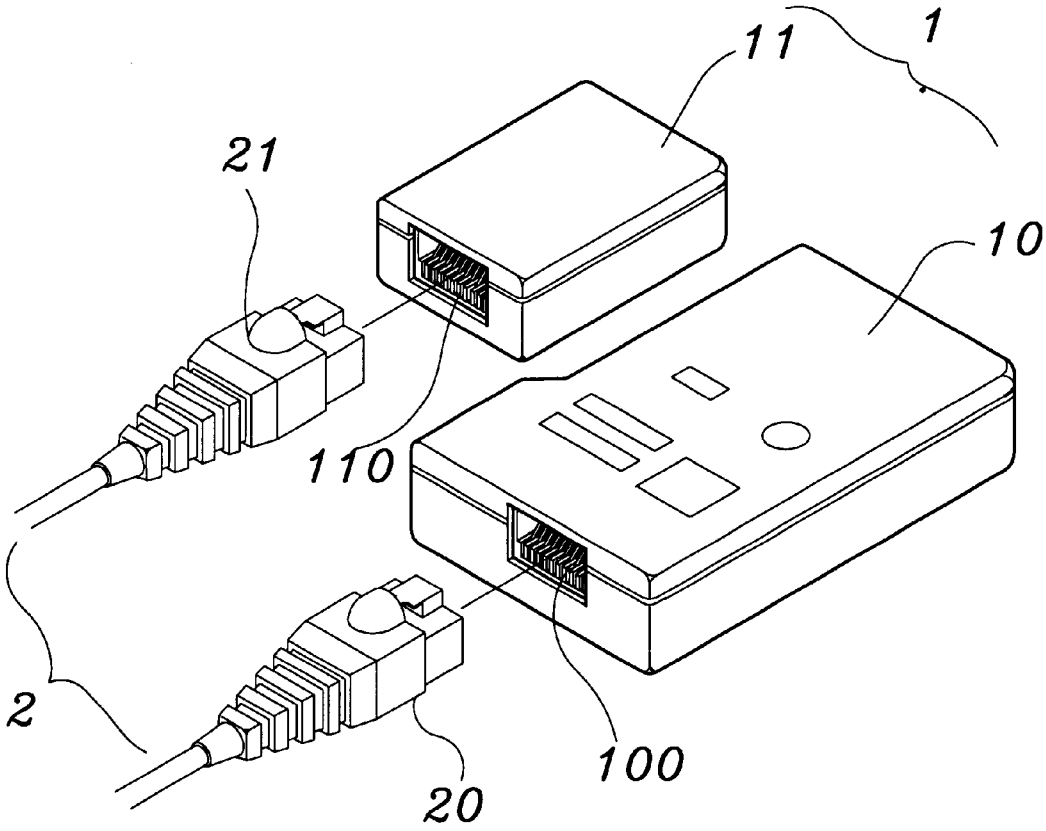
FIG. 1 PRIOR ART
FIG. 1 is a perspective view of a prior art network cable tester.
Figure 2:
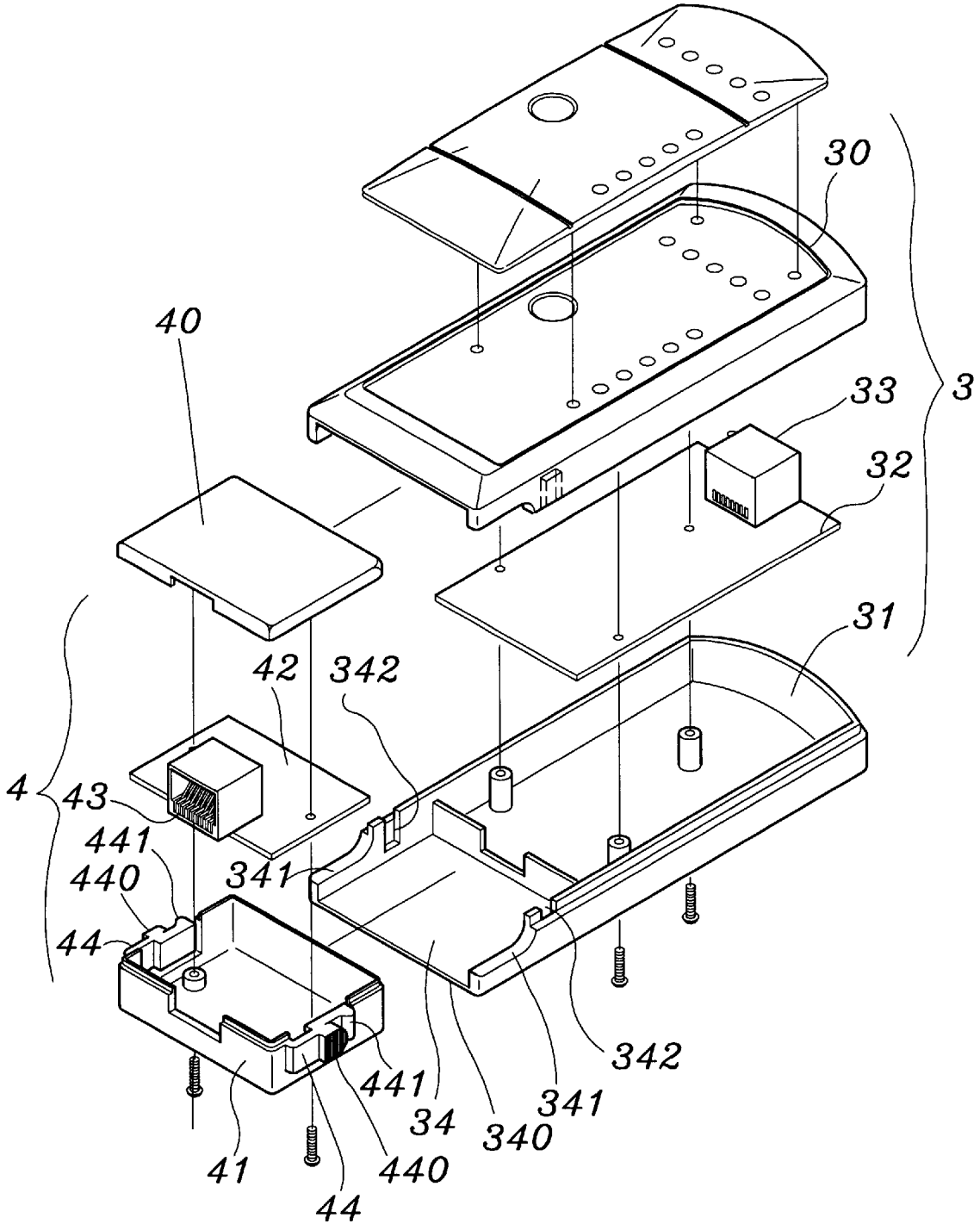
FIG. 2 is an exploded perspective view showing one embodiment of the present invention.
Figure 3:
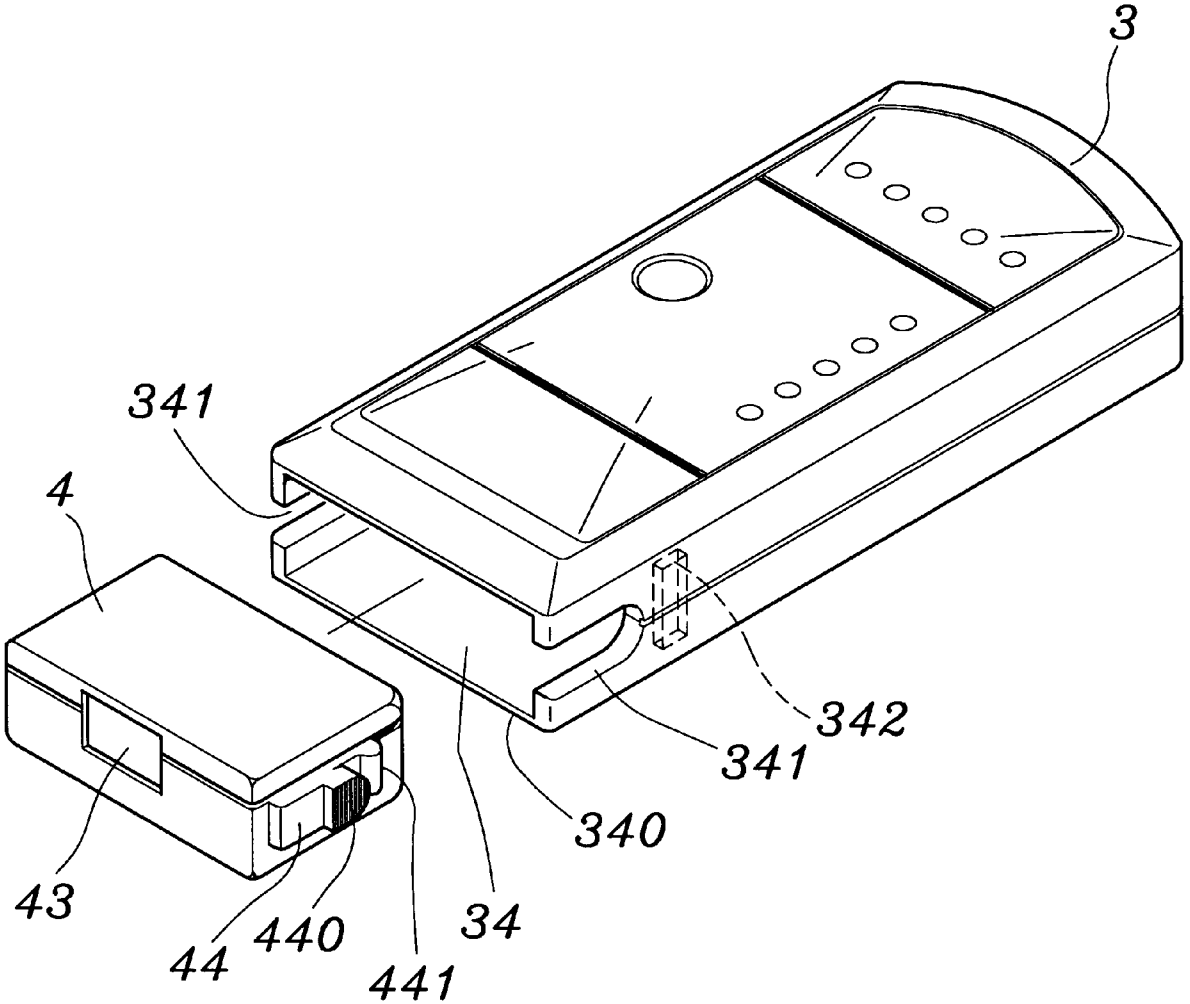
FIG. 3 is an assembled perspective view of one embodiment of the present invention.
Figure 4:
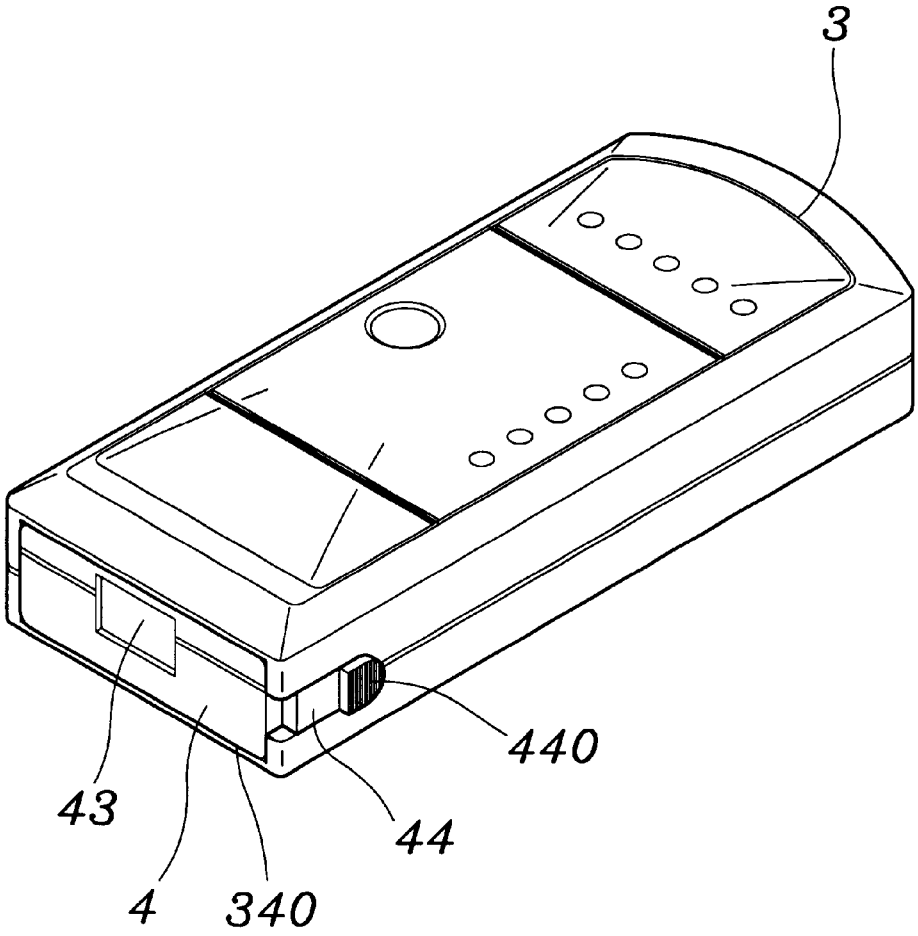
FIG. 4 is a perspective view of one embodiment of the present invention showing the primary and secondary devices coupled together.

With reference now to FIGS. 2–7, the improved structure for a network cable tester according to an embodiment of the present invention is illustrated. The improved structure of a network cable tester of the present invention includes a primary device 3 and a secondary device 4, as shown in FIGS. 2, 3, and 4.

The primary device 3 includes a housing case formed by locking together a first half case 30 and a second half case 31 within which a circuit board 32 and an RJ-45 type network receptacle 33 are installed. A longitudinal end of the primary device 3 housing case is formed with a compartment 34 having an opening 340. Each of the lateral walls at opposing sides of the compartment 34 is formed with a slot 341, and a buckle groove 342 offset therefrom.

The secondary device 4 also includes a housing case formed by locking a first half case 40 and a second half case 41, within which a circuit board and an RJ-45 type network receptacle 43 are installed. At opposing lateral sides of the housing case are formed respective resilient pressing buckles 44, each preferably having a leaf configuration with only one end connected to the case. A pressing key 440 is formed on each resilient pressing buckle 44 to protrude outward therefrom. A hook 441 is formed at a free end of each pressing buckle 44.

Figure 5:
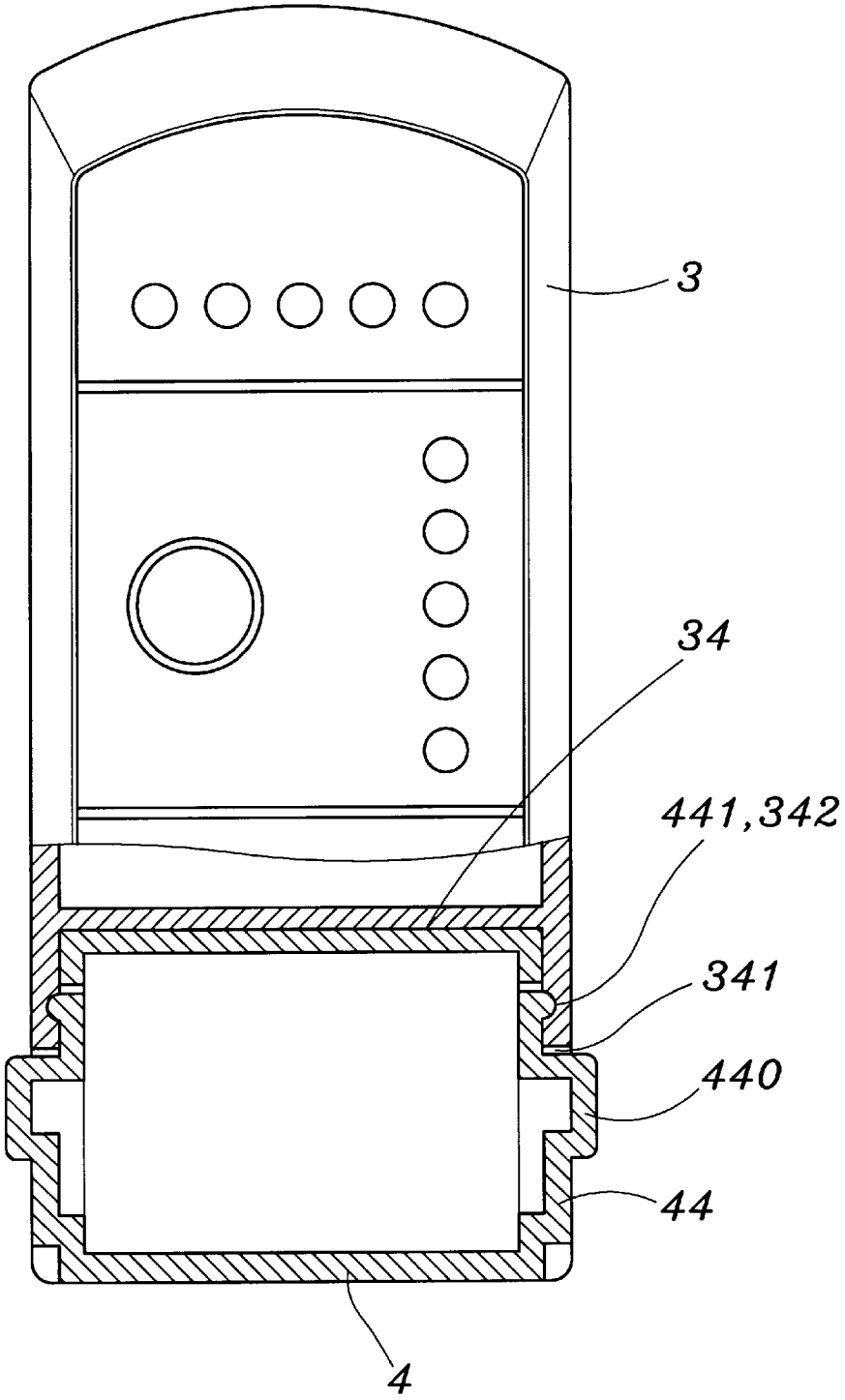
FIG. 5 is a partial cross-sectional view showing the primary and secondary devices coupled together.

Thus, as shown in FIGS. 4 and 5, when the primary device 3 and the secondary device 4 are not in use, the secondary device 4 may be inserted into the compartment 34 on the end of the primary device 3. The resilient pressing buckles 44 at opposing sides of the secondary device 4 engage the primary device 3 along the slots 341 until the hook 441 on the buckle's free ends respectively engage the buckle grooves 342 on the lateral walls of the primary device 3. The secondary device 4 may thus be completely hidden within the primary device 3 and retained therein by the buckling mechanisms. Hence, a compact device having a streamlined appearance (of the primary device 3) results. With the primary and secondary devices combined as one body in this manner, space is employed efficiently, yielding a network cable tester which may be easily carried and stored.

Figure 6:
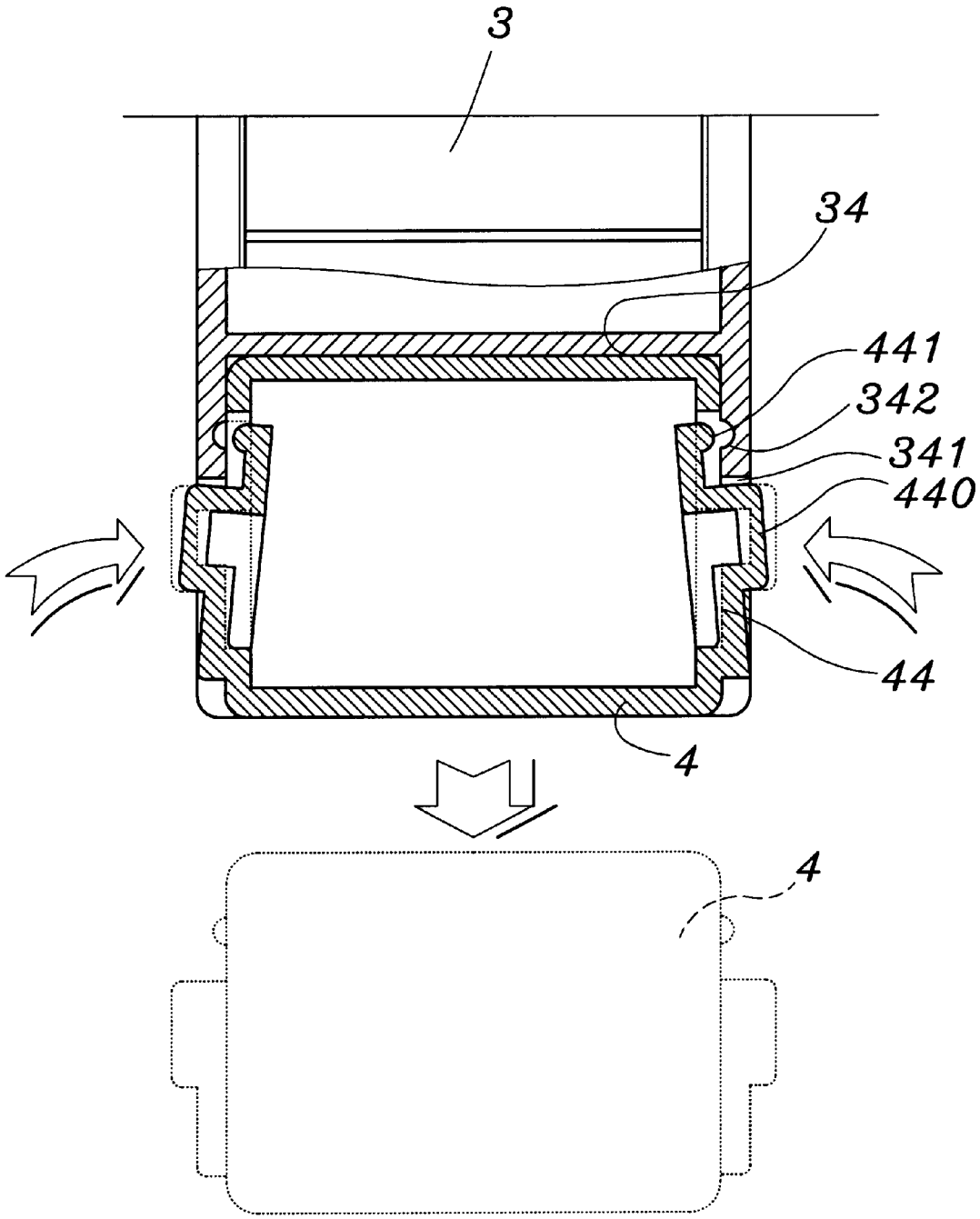
FIG. 6 is a partial cross-sectional view showing the secondary device removed from the primary device; and, FIG. 7 is a perspective view illustrating the use of one embodiment of the present invention.
Figure 7:
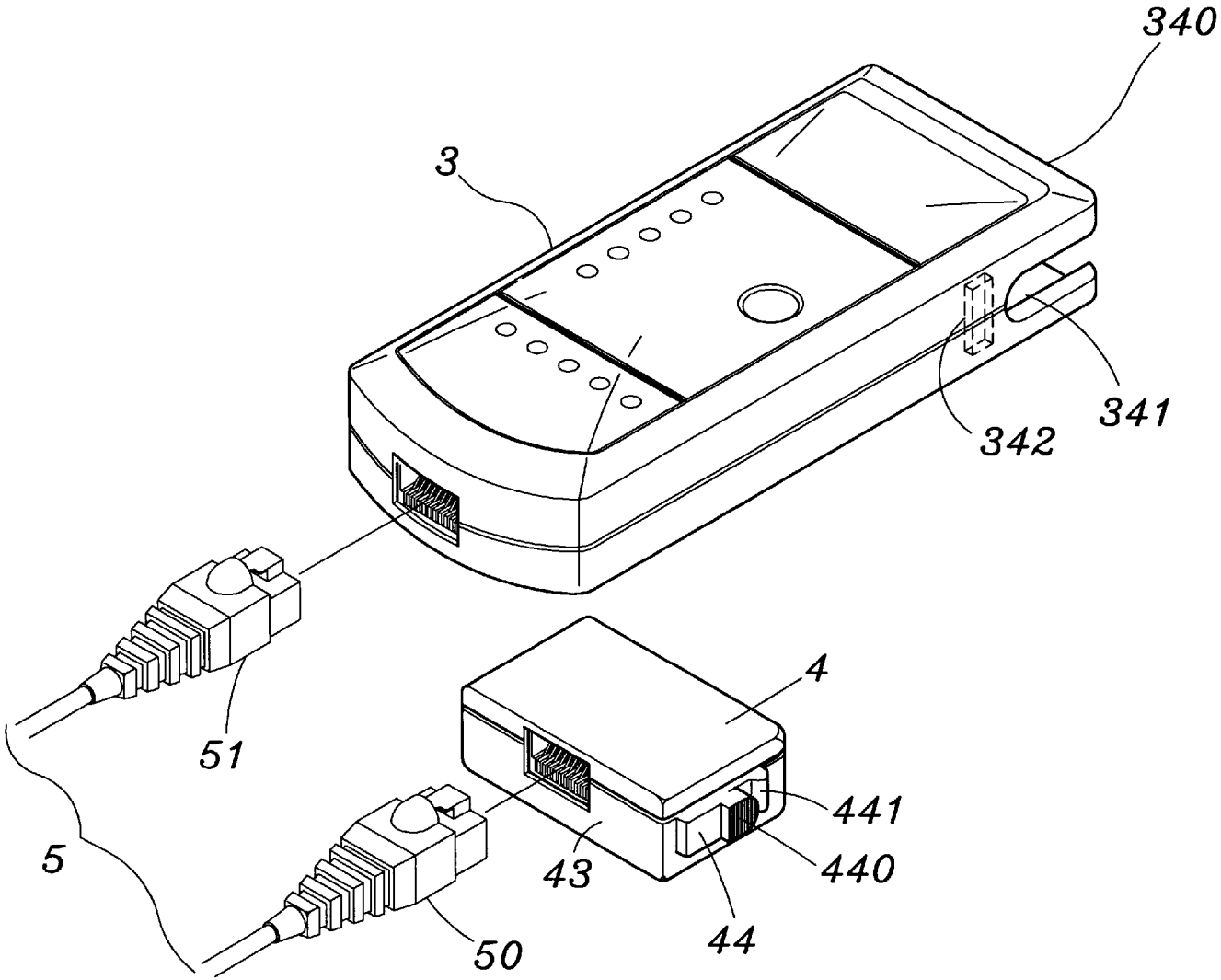

As shown in FIG. 6, when the network cable tester is to be used, the user need only press the keys 440 exposed through the two slots 341 of the primary device 3. Then the hooks 441 of the resilient pressing buckle 44 will release from the grooves 342, permitting the secondary device's convenient removal. As shown in FIG. 7, the network receptacles 43 and 33 of the secondary and primary devices 4 and 3 are engaged respectively by the network plugs 50 and 51 at two ends of the given network cable 5, such that testing of the cable's transmission quality may occur.

The aforementioned improved structure for a network cable tester according to the present invention substantially overcomes the drawbacks in the prior art, such as those deriving from the detached structures of the primary and secondary devices. The improved structure permits convenient carrying and storage.

Although the present invention has been described with reference to the preferred embodiments, it will be understood that the invention is not limited to the described details thereof. Various substitutions and modifications suggested in the foregoing Description, and others, will occur to those of ordinary skill in the art. Therefore, all such substitutions and modifications are intended to be embraced within the scope of the invention as defined in the appended claims.

What is claimed is:

1. A cable tester assembly comprising:

(a) a primary device including a longitudinally extended first case and a first circuit board and first network receptacle housed therein, said first case having a longitudinal end section, said first case having formed at said longitudinal end section a wall portion defining a compartment and an opening communicating therewith, said wall portion having a pair of laterally opposed surfaces, each said surface having formed therein a buckle groove recess; and, (b) a secondary device detachably coupled to said primary device, said secondary device including a second case and a second circuit board and second network receptacle housed therein, said second case being substantially fully received in releasable manner within said compartment of said first case, said secondary device having an outer wall portion, said outer wall portion having respectively formed at opposed sides thereof a pair of resilient buckle members, each said buckle member having an outwardly biased hook section for engaging one said buckle groove recess of said primary device;

whereby said secondary device may be retained substantially fully within said primary device in releasably locked manner.

2. The cable tester assembly as recited in claim 1 wherein said wall portion of said primary device has formed in each said laterally opposed surface thereof a slot, said slot extending longitudinally from said opening and being longitudinally offset from at least one said buckle groove recess.

3. The cable tester assembly as recited in claim 2 wherein each said buckle member of said secondary device includes a pressing key section offset from said hook section, said pressing key section slidably engaging one said slot of said primary device, said pressing key section protruding through said slot when said secondary device is retained within said primary device.

4. The cable tester assembly as recited in claim 3 wherein said hook section is disposed at a terminal end of said buckle member, each said buckle member thereby having substantially a leaf spring configuration.

* * * * *